US007030828B2

(12) United States Patent
Kato et al.

(10) Patent No.: US 7,030,828 B2
(45) Date of Patent: Apr. 18, 2006

(54) COIL ANTENNA

(75) Inventors: Yoshihiko Kato, Sendai (JP); Naoharu Yamamoto, Sendai (JP); Makoto Teshima, Sendai (JP); Mitsuharu Sato, Sendai (JP)

(73) Assignee: NEC TOKIN Corporation, Sendai (JP)

( * ) Notice: Subject to any disclaimer, the term of this patent is extended or adjusted under 35 U.S.C. 154(b) by 0 days.

(21) Appl. No.: 10/960,346

(22) Filed: Oct. 6, 2004

(65) Prior Publication Data

US 2005/0237254 A1 Oct. 27, 2005

(30) Foreign Application Priority Data

Apr. 27, 2004 (JP) ..... 2004-131977

(51) Int. Cl.
*H01Q 7/08* (2006.01)

(52) U.S. Cl. ..... 343/788; 343/713; 343/718; 343/787

(58) Field of Classification Search ..... 343/718, 343/787, 788
See application file for complete search history.

(56) References Cited

U.S. PATENT DOCUMENTS

| | | | | |
|---|---|---|---|---|
| 3,778,836 | A | 12/1973 | Tanaka | |
| 4,947,179 | A * | 8/1990 | Ganter et al. | 343/718 |
| 5,136,303 | A | 8/1992 | Cho et al. | |
| 5,220,338 | A | 6/1993 | Matsushita | |
| 6,018,298 | A * | 1/2000 | Endo et al. | 340/572.5 |
| 6,134,188 | A | 10/2000 | Ganter et al. | |
| 6,229,444 | B1 | 5/2001 | Endo et al. | |
| 6,329,903 | B1 | 12/2001 | Yamamori | |
| 6,448,491 | B1 | 9/2002 | Sato et al. | |
| 6,677,851 | B1 | 1/2004 | Losey | |
| 6,712,989 | B1 | 3/2004 | Awakura et al. | |
| 6,723,914 | B1 | 4/2004 | Kamei et al. | |
| 6,812,707 | B1 * | 11/2004 | Yonezawa et al. | 324/326 |
| 2002/0039667 | A1 | 4/2002 | Takaya et al. | |
| 2004/0090868 | A1 * | 5/2004 | Endo et al. | 368/10 |
| 2005/0007296 | A1 * | 1/2005 | Endo et al. | 343/895 |

FOREIGN PATENT DOCUMENTS

| | | |
|---|---|---|
| EP | 0 443 491 A1 | 8/1991 |
| EP | 0 480 064 A1 | 4/1992 |
| EP | 0 877 394 A1 | 11/1998 |
| EP | 1 150 311 A2 | 10/2001 |
| JP | 2001-337181 A | 12/2001 |

* cited by examiner

*Primary Examiner*—Tho Phan
(74) *Attorney, Agent, or Firm*—Frishauf, Holtz, Goodman & Chick, P.C.

(57) ABSTRACT

A coil antenna is disclosed comprising a magnetic core and a wire wound around the magnetic core. The magnetic core is made of a mixture comprising soft magnetic powder and an organic binder agent. The magnetic core has a specific complex permeability whose real part μ' is 20 or more over a frequency range of 10 MHz or less and whose imaginary part μ" is 10 or more over a frequency range of 10 MHz or more so that the magnetic core is also servable as a noise suppressor against high-frequency noise.

31 Claims, 2 Drawing Sheets

COIL ANTENNA

BACKGROUND OF THE INVENTION

This invention relates to a coil antenna used for transmitting and/or for receiving radio signals within a low or medium frequency band, e.g., a frequency range of from 10 kHz to 5 MHz. In particular, this invention relates to the coil antenna which also has another function different from the normal function to transmit and/or to receive low- or medium-frequency signals.

There have been used or proposed various kinds of apparatuses, systems, or terminals, which transmit and/or receive radio signals of low or medium frequencies. A typical, well-known system is an AM (amplitude modulation) radio system. A relatively new system is a radio controlled timepiece such as a radio controlled clock or a radio controlled wristwatch. Other relatively new system is an immobilizer for vehicle, a remote keyless entry system for vehicle or for house, or an RFID (radio frequency identification) system. For more information about a radio controlled wristwatch, see U.S. Pat. No. 6,134,188, which is incorporated herein by reference in its entirety. For more information about a remote keyless entry system for vehicle, see U.S. Pat. No. 6,677,851, which is incorporated herein by reference in its entirety.

An important component common to the above-mentioned apparatuses or the like is an antenna, especially, a coil antenna which comprises a magnetic core and a coil wound around the magnetic core.

A well-known magnetic core for coil antenna is made of a sintered ferrite core or a laminated core consisting of amorphous metal sheets. The former is easily breakable and does not have flexibility on design because of its hardness. The latter is not easily machinable and is expensive so that its manufacturing cost becomes high.

Another coil antenna is disclosed in JP-A 2001-337181, which is incorporated herein by reference in its entirety. The disclosed coil antenna is used for a radio controlled timepiece or wristwatch and has a magnetic core comprised of powder particles or flakes of ferrite or metal and a plastic binder agent. The magnetic core of JP-A 2001-337181 possesses high impact resistance because of its softness and can be readily formed with low cost.

SUMMARY OF THE INVENTION

It is an object of the present invention to provide a different type of a coil antenna for a low or medium frequency band, namely, a multifunctional coil antenna.

According to an aspect of the present invention, a coil antenna comprises a magnetic core and a wire wound around the magnetic core, wherein the magnetic core is made of a mixture comprising soft magnetic powder and an organic binder agent and has a specific complex permeability whose real part $\mu'$ is 20 or more over a frequency range of 10 MHz or less and whose imaginary part $\mu''$ is 10 or more over a frequency range of 10 MHz or more.

Because the magnetic core has the specific complex permeability, the coil antenna has high sensitivity in a low or medium frequency band, while the magnetic core of the coil antenna can suppress noise whose frequency ranges from high frequency to ultra high frequency. In other words, the coil antenna according to an aspect of the present invention is a multifunctional coil antenna which is also servable as a noise suppressor.

An appreciation of the objectives of the present invention and a more complete understanding of its structure may be had by studying the following description of the preferred embodiment and by referring to the accompanying drawings.

DESCRIPTION OF PREFERRED EMBODIMENTS

Figure 1:
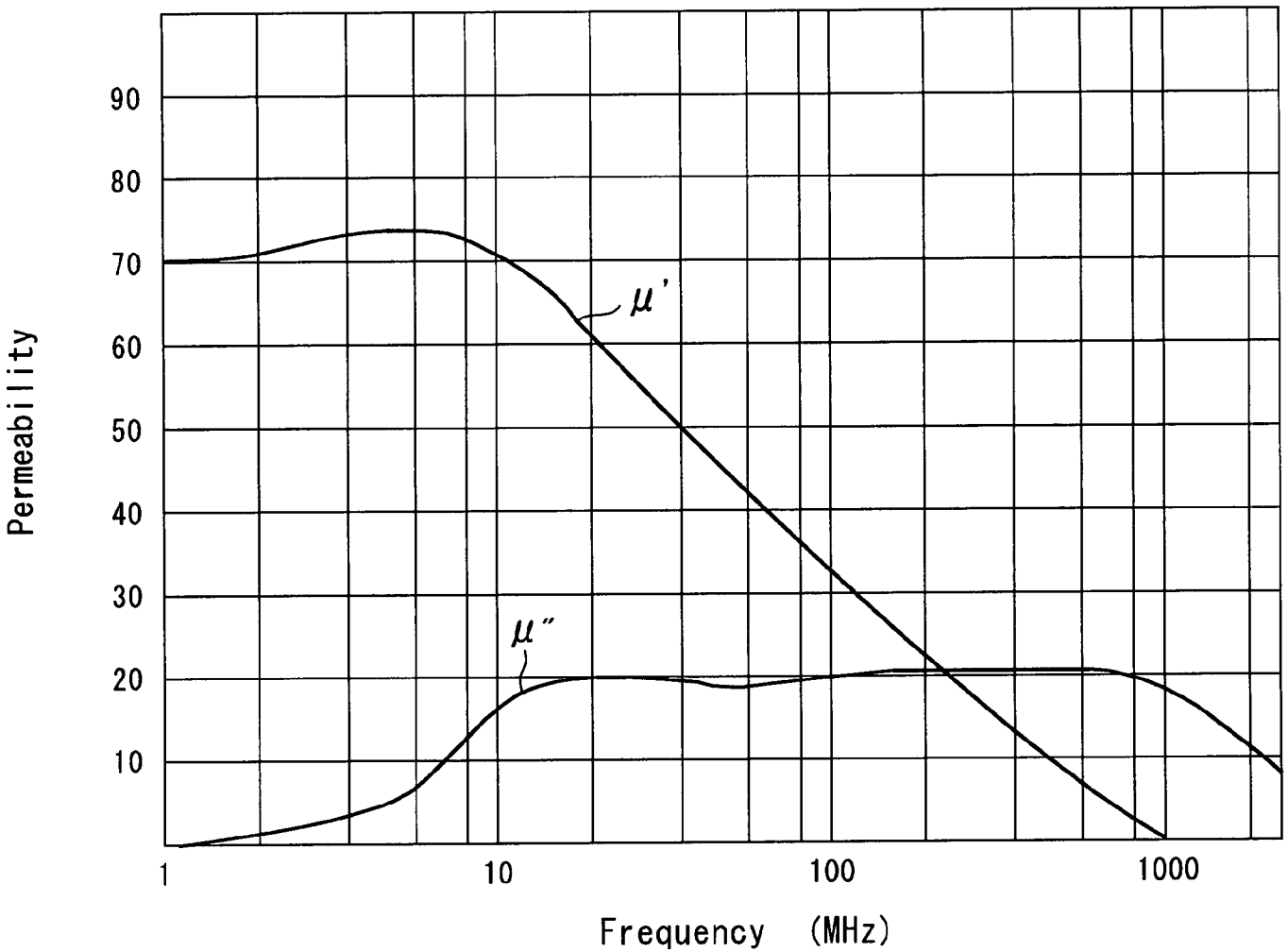
FIG. 1 is a semilogarithmic graph showing f-μ characteristic of a magnetic core for signal transmission in accordance with an embodiment of the present invention.

An embodiment of the present invention has two different coil antennas. One of them is for signal transmission, while the other is for signal reception. Each of the coil antennas comprises a magnetic core and a wire wound around the magnetic core. Each of the magnetic cores is made of a mixture comprising soft magnetic powder and an organic binder agent and is formed to be flexible and bendable. The soft magnetic powder comprises a plurality of particles each of which is coated with an insulator layer.

In this embodiment, each of the magnetic cores is formed in a plate-like shape. In detail, the magnetic core for signal transmission has a size of $8\times8\times60$ mm$^3$, and the wire for 10 T is wound thereon. The magnetic core for signal reception has a size $2\times10\times60$ mm$^3$, and the wire for 100 T is wound thereon. Each of the wires is a polyurethane enameled copper wire. Each of the magnetic cores of the plate-like shapes is formed by stacking a plurality of sheet-like shaped magnetic cores thinner than the magnetic core of the plate-like shape. According to the forming method, a large press machine is not required for making a large sized magnetic core. Also, a complicated mold or die is not required for making a magnetic core of a complicated shape, because the sheet-like shaped magnetic core can be easily cut by the use of a cutter or a pair of scissors. The magnetic core may have a string-like shape.

Each of the magnetic cores of the present embodiment is obtained by, under the normal atmospheric pressure, casting or molding and curing or hardening the above-mentioned mixtures of the soft magnetic powder and the organic binder agent. The compression molding and the injection molding are not required to obtain the magnetic cores of the present embodiment.

In this embodiment, the coil antenna for signal transmission and the other coil antenna for signal reception are similar to each other, except for their size and their magnetic flux density of the wires as mentioned above. Now, explanations will be made of the common matters.

The soft magnetic powder of this embodiment is Fe—Si—Al alloy powder, especially, Sendust powder. The soft magnetic powder may be other powder. For example, the soft magnetic powder may be Fe carbonyl powder, ferrite powder, or pure iron powder. The soft magnetic powder may be powder made of Fe—Si—Al alloy, Fe—Ni alloy (Permalloy), Fe—Co alloy, Fe—Co—Si alloy, Fe—Si—V alloy, Fe—Co—B alloy, Co base amorphous metal, Fe base amorphous metal, or Mo-permalloy. Also, the soft magnetic powder may be a combination of the above-mentioned powders.

In this embodiment, the soft magnetic powder comprises flat particles. In more detail, each of the flat particles has an aspect ratio of 5 or more and its diameter is about 35 μm.

In this embodiment, the insulator layer is made of non-magnetic material, especially, an oxide film. The oxide film of this embodiment is formed in an annealing process for the soft magnetic powder. The oxide film may be obtained by another means or way. The insulator layer may be made of an organic binder agent.

The organic binder agent of the present embodiment is chlorinated polyethylene. A titanate coupler is added to the organic binder in this embodiment. Alternatively, a silane coupler or an aluminate coupler may be used. Also, no coupler may be used.

The organic binder agent may be made of another elastomer agent. For example, the organic binder agent may be thermoplastic resin, such as resin made of polyester resin, polyvinyl chloride resin, chlorinated polyethylene, polyvinyl butyral resin, polyurethane resin, cellulosic resin, polyvinyl acetate resin, phenoxy resin, polypropylene, polycarbonate resin, ABS (acrylonitrile-butadiene-styrene copolymer) resin, polyvinyl alcohol resin, polyimide resin, polyethylene resin, polyamide resin, polyacrylic ester resin, or polyacrylonitrile resin, or copolymer thereof. The organic binder agent may be thermosettable resin, such as resin made of epoxy resin, phenol resin, amide resin, imide resin, diallyl phthalate resin, unsaturated polyester resin, melamine resin, urea resin, or silicone resin, or a combination thereof. Alternatively, the organic binder agent may be synthetic rubber, such as nitrile-butadiene rubber, styrene-butadiene rubber or a combination thereof. Furthermore, the organic binder agent is a plastomer agent, provided that it can provide a flexible, bendable, magnetic core. Another coupling agent can be added to the organic binder.

In this embodiment, the mixing ratio of the soft magnetic power is 80 wt %, and the total mixing ratio of the organic binder agent and the coupler is 20 wt %. The mixing ratio of the soft magnetic powder in the mixture may be in a range of from 60 wt % to 95 wt %, both inclusive. The mixing ratio of the organic binder in the mixture may be in a range of from 5 wt % to 40 wt %, both inclusive. If a coupler added thereto, the mixing ratio of the coupler in the mixture is 5 wt % or less.

The mixture may further comprise an organic flame retardant, such as an organic flame retardant made of halogenide, bromide polymer or a combination thereof.

Also, the mixture may further comprise dielectric powder. Alternatively, the coil antenna may further comprise a dielectric layer, which is formed on at least one part of the magnetic core. For example, the dielectric layer is formed on a surface of the plate-shaped magnetic core. In this case, the wire is wound around the magnetic core and the dielectric layer.

Furthermore, the coil antenna may be covered by a waterproofing case, which is made of flexible elastomer, silicone resin, gum resin, polyamide resin, or a polyester resin.

To evaluate the coil antennas for signal transmission and for signal reception in accordance with the present embodiment, the above-mentioned coil antennas were formed, and their characteristics were measured. As comparative examples, two coil antennas were formed of sintered ferrite cores and wires wound thereon; one of the comparative coil antenna was for signal transmission, while the other was for signal reception. The comparative coil antennas had the same structures, shapes, sizes as those of the embodiment except for the materials of the magnetic cores. The characteristics of the comparative coil antennas were also measured. The measured results are as follows.

Each of the magnetic cores of the present embodiment had rubber hardness degree of 60 or more, which was measured by using type-A durometer in accordance with JIS K 6253. JIS is an abbreviation of "Japan Industrial Standard", and JIS K 6253 is entitled "Hardness testing methods for rubber, vulcanized or thermoplastic". The magnetic core of the present embodiment had a tensile strength of 3.8 MPa, which was measured in accordance with JIS K 6263. The JIS K 6263 is entitled "Rubber, vulcanized or thermoplastics—Determination of stress relaxation".

The coil antenna for signal transmission and the coil antenna for signal reception had superior transmission and reception characteristics in comparison with the comparative coil antenna for signal transmission and the comparative coil antenna for signal reception.

In addition, the superior transmission and reception characteristics were kept even when the coil antennas were bent. This is because the particles of the magnetic powder are separated from and independent of each other and work as "micro-cores", respectively. The number of the micro-cores does not change even when the coil antenna is bent because each of the particles is coated with the oxide film.

Furthermore, f-μ characteristic of the coil antenna for signal transmission is shown in a semilogarithmic graph of FIG. 1, wherein its vertical axis shows real part μ' and imaginary part μ" of the complex permeability of the coil antenna. The horizontal axis of the graph shows frequency (MHz).

With reference to FIG. 1, the magnetic core has a complex permeability whose real part μ' is 70 or more over a frequency range of 10 MHz or less and whose imaginary part μ" is 10 or more over a frequency range of from 10 MHz to 2000 MHz. In detail, in a low or medium frequency band, the real part μ' has a flat portion while the imaginary part μ" is kept at zero or extremely low value so that the magnetic core has high sensitivity in a low or medium frequency band. In a high frequency band, the imaginary part μ" has a relatively large value so that the magnetic core of the coil antenna can serve as a superior noise suppressor against high-frequency noise. The f-μ characteristic required for the coil antenna is not limited to the embodiment but may be a specific complex permeability whose real part μ' is 20 or more over a frequency range of 10 MHz or less and whose imaginary part μ" is 10 or more over a frequency range of 10 MHz or more.

The above-mentioned coil antenna is applicable to an electronic apparatus comprising a radio transmitting/receiving system which is transmittable/receivable radio signals ranging from 10 kHz to 5 MHz. In this case, the coil antenna is also servable as a high-frequency noise suppressor within the electronic apparatus.

Figure 2:
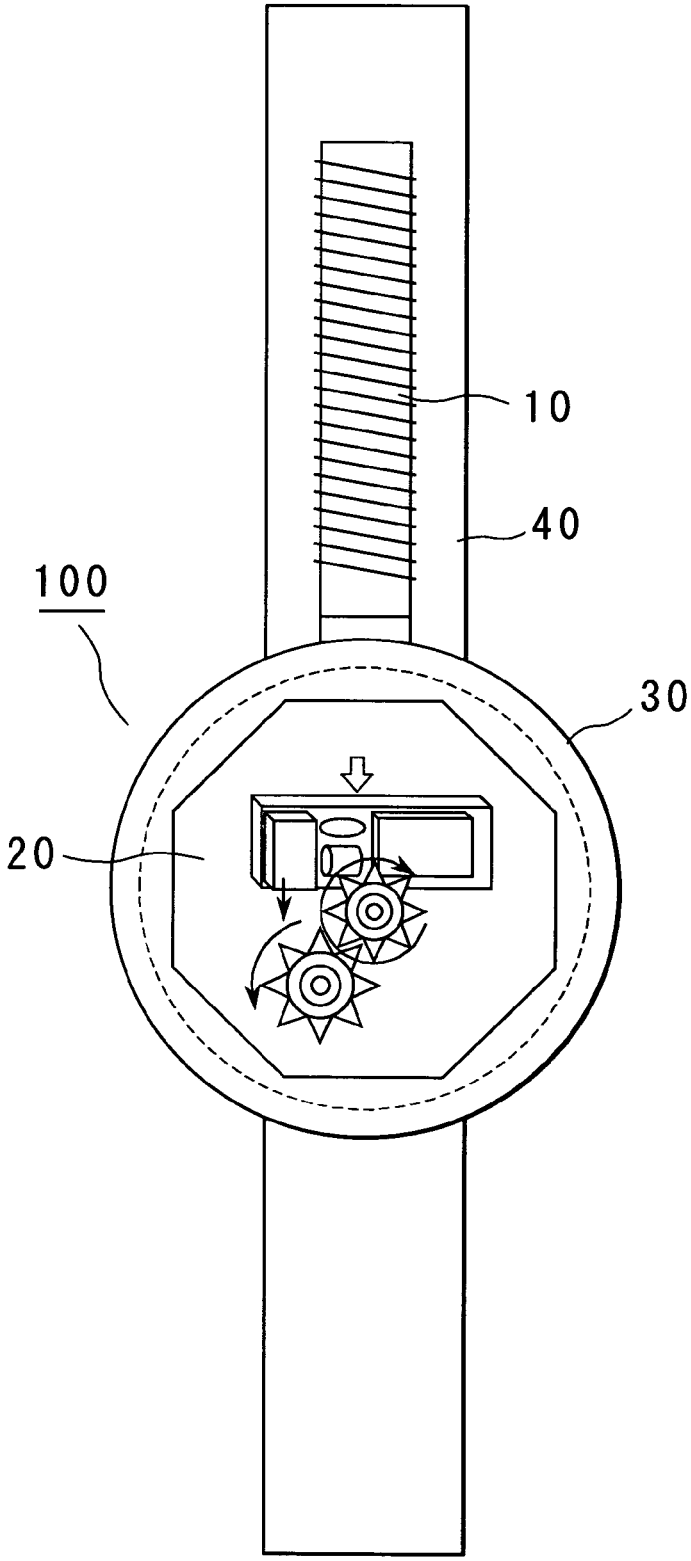
FIG. 2 is a plan view showing a radio controlled wristwatch which comprises a coil antenna according to an embodiment of the present invention.

FIG. 2 shows an example, in which the above-mentioned coil antenna 10 is applied to a radio controlled wristwatch 100. The radio controlled wristwatch 100 further comprises a mechanism 20 for automatically adjusting a time in accordance with radio signals received by using the coil antenna 10. Specifically, the radio controlled wristwatch 100 comprises a case 30 and watchbands 40 each depending therefrom. The illustrated coil antenna 10 is embedded in one of the watchbands 40. Alternatively, the magnetic core of a coil antenna may be curved within a plane parallel to the bottom plane of the case 30 and extends along an inside of the peripheral wall of the case 30.

Furthermore, the coil antenna of the present embodiment is applicable to a remote keyless entry system, wherein the coil antenna is for receiving user identification signals, which are transmitted from an object carried by a user. In case where a vehicle adopts the remote keyless entry system, the coil antenna may be embedded within the vehicle. More specifically, the coil antenna may be contained in a door handle of the vehicle.

The above-mentioned coil antenna can be used as a multiband antenna. For example, a single coil antenna can be used at a frequency for a radio controlled timepiece and at another frequency for a remote keyless entry system.

The preferred embodiments of the present invention will be better understood by those skilled in the art by reference to the above description and figures. The description and preferred embodiments of this invention illustrated in the figures are not to intend to be exhaustive or to limit the invention to the precise form disclosed. They are chosen to describe or to best explain the principles of the invention and its applicable and practical use to thereby enable others skilled in the art to best utilize the invention.

While there has been described what is believed to be the preferred embodiment of the invention, those skilled in the art will recognize that other and further modifications may be made thereto without departing from the sprit of the invention, and it is intended to claim all such embodiments that fall within the true scope of the invention.

What is claimed is:

1. A coil antenna comprising a magnetic core and a wire wound around the magnetic core, wherein the magnetic core is made of a mixture comprising soft magnetic powder and an organic binder agent and has a specific complex permeability whose real part μ' is 20 or more over a frequency range of 10 MHz or less and whose imaginary part μ" is 10 or more over a frequency range of 10 MHz or more.

2. The coil antenna according to claim 1, wherein the organic binder agent is a plastomer agent.

3. The coil antenna according to claim 1, wherein the organic binder agent is an elastomer agent.

4. The coil antenna according to claim 3, wherein the organic binder agent is thermoplastic resin.

5. The coil antenna according to claim 4, wherein the organic binder agent is made of polyester resin, polyvinyl chloride resin, chlorinated polyethylene, polyvinyl butyral resin, polyurethane resin, cellulosic resin, polyvinyl acetate resin, phenoxy resin, polypropylene, polycarbonate resin, ABS (acrylonitrile-butadiene-styrene copolymer) resin, polyvinyl alcohol resin, polyimide resin, polyethylene resin, polyamide resin, polyacrylic ester resin, or polyacrylonitrile resin, or copolymer thereof.

6. The coil antenna according to claim 3, wherein the organic binder agent is thermosettable resin.

7. The coil antenna according to claim 6, wherein the organic binder agent is made of epoxy resin, phenol resin, amide resin, imide resin, diallyl phthalate resin, unsaturated polyester resin, melamine resin, urea resin, or silicone resin, or a combination thereof.

8. The coil antenna according to claim 3, wherein the organic binder agent is synthetic rubber.

9. The coil antenna according to claim 8, wherein the organic binder agent is made of nitrile-butadiene rubber, styrene-butadiene rubber or a combination thereof.

10. The coil antenna according to claim 1, wherein the soft magnetic powder is Fe carbonyl powder, ferrite powder, pure iron powder, powder made of Fe—Si—Al alloy, Fe—Ni alloy, Fe—Co alloy, Fe—Co—Si alloy, Fe—Si—V alloy, Fe—Co—B alloy, Co base amorphous metal, Fe base amorphous metal, or Mo-permalloy, or a combination thereof.

11. The coil antenna according to claim 1, wherein a mixing ratio of the organic binder in the mixture is in a range of from 5 percents, by weight, to 40 percents, by weight, both inclusive, and another mixing ratio of the soft magnetic powder in the mixture is in a range of from 60 percents, by weight, to 95 percents, by weight, both inclusive.

12. The coil antenna according to claim 1, wherein the mixture further comprises an organic flame retardant.

13. The coil antenna according to claim 12, wherein the organic flame retardant is made of halogenide, bromide polymer or a combination thereof.

14. The coil antenna according to claim 1, wherein the soft magnetic powder comprises a plurality of flat particles.

15. The coil antenna according to claim 14, wherein each of the flat particles has an aspect ratio of 5 or more.

16. The coil antenna according to claim 1, wherein the magnetic core is formed flexible and bendable.

17. The coil antenna according to claim 16, wherein the magnetic core is obtainable by, under the normal atmospheric pressure, casting or molding and curing or hardening the mixture.

18. The coil antenna according to claim 16, wherein the soft magnetic powder comprises a plurality of particles each of which is coated with an insulator layer.

19. The coil antenna according to claim 18, wherein the insulator layer is made of non-magnetic material.

20. The coil antenna according to claim 19, wherein the insulator layer is made of an oxide film.

21. The coil antenna according to claim 19, wherein the insulator layer is made of an organic binder agent.

22. The coil antenna according to claim 16, wherein the magnetic core has a plate-like shape, a sheet-like shape, or a string-like shape.

23. The coil antenna according to claim 1, wherein the mixture further includes dielectric powder.

24. The coil antenna according to claim 1, further comprising a dielectric layer which is formed on at least one part of the magnetic core, wherein the wire is wound around the magnetic core and the dielectric layer.

25. An electronic apparatus comprising a radio transmitting/receiving system which is transmittable/receivable radio signals ranging from 10 kHz to 5 MHz, wherein the radio transmitting/receiving system comprises the coil antenna according to claim 1, and the coil antenna also serves as a high-frequency noise suppressor within the electronic apparatus.

26. A radio controlled wristwatch comprising: the coil antenna according to claim 1; and a mechanism for automatically adjusting a time in accordance with radio signals received by using the coil antenna.

27. The radio controlled wristwatch according to claim 26, further comprising a case and a watchband depending therefrom, wherein the coil antenna is provided for the watchband.

28. The radio controlled wristwatch according to claim 26, further comprising a case and a watchband depending therefrom, wherein: the case comprises a bottom plane and a peripheral wall; and the magnetic core is curved within a plane parallel to the bottom plane and extends along an inside of the peripheral wall.

29. A remote keyless entry system comprising the coil antenna according to claim 1, wherein the coil antenna is for receiving user identification signals, which are transmitted from an object carried by a user.

30. A vehicle adopting the remote keyless entry system according to claim 29, wherein the coil antenna is embedded within the vehicle.

31. The vehicle according to claim 30, wherein the coil antenna is contained in a door handle of the vehicle.

* * * * *